United States Patent [19]

Johansson

[11] 4,198,302

[45] Apr. 15, 1980

[54] APPARATUS FOR RELIEVING BLOCKAGE OF THE PULP DISCHARGE PASSAGE IN A CYCLONE IN A PULPING SYSTEM

[75] Inventor: Johan G. I. Johansson, Taby, Sweden

[73] Assignee: Defibrator Aktiebolag, Stockholm, Sweden

[21] Appl. No.: 898,939

[22] Filed: Apr. 21, 1978

[30] Foreign Application Priority Data

Apr. 28, 1977 [SE] Sweden ..... 7704941

[51] Int. Cl.[2] ..... B01D 21/26

[52] U.S. Cl. ..... 210/512 R; 209/144; 209/211

[58] Field of Search ..... 210/512 R, 304, 84; 209/144, 211; 55/430; 198/672, 674

[56] References Cited

U.S. PATENT DOCUMENTS

| | | | |
|---|---|---|---|
| 619,912 | 2/1899 | Sutcliffe | 55/430 |
| 816,460 | 3/1906 | Geisendorfer et al. | 55/430 |
| 1,914,486 | 6/1933 | Burton | 198/674 |
| 3,687,288 | 8/1972 | Lynch et al. | 210/512 R |

*Primary Examiner*—Frank Sever
*Attorney, Agent, or Firm*—Eric Y. Munson

[57] ABSTRACT

Apparatus for relieving blockage of the pulp discharge passage in a cyclone separator included in a pulping system. The pulp stock is treated in an environment of superatmospheric steam and discharged together with the steam into the separator cyclone. The separated processing steam is evacuated from the cyclone while the steam liberated pulp stock is propelled through a throat which tapers towards the discharge valve by a screw conveyor whose flights are contoured to rotate snugly within the tapered throat. The discharge valve is controlled to maintain a predetermined rate of discharge and a predetermined superatmospheric pressure within the cyclone to allow evacuation of steam therefrom. The shaft of the screw conveyor is reciprocally mounted in the cyclone to allow the screw flights to yield in response to a predetermined excessive thrust resulting from compacted pulp stock blocking the throat, to provide a by-pass between the screw flights and the throat wall and thereby relieve the blockage. The invention may also include sensor means for controlling the rate of discharge in response to variations in thrust on the compacted pulp stock by the screw conveyor.

8 Claims, 2 Drawing Figures

APPARATUS FOR RELIEVING BLOCKAGE OF THE PULP DISCHARGE PASSAGE IN A CYCLONE IN A PULPING SYSTEM

FIELD OF THE INVENTION

The invention relates to a pulping system for the production of pulp from ligno-cellulosic fiber material in which the pulp stock, such as wood chips, is defibrated or refined in an environment of superatmospheric steam. The defibrated pulpstock, together with the high-pressure steam, is discharged from the defibrator or refiner and conveyed into a cyclone, where the steam is separated and evacuated while the steam liberated pulp stock is discharged from further processing.

BACKGROUND OF THE INVENTION

During production of fibre pulp from lignocellulosic materials by modern grinding processes, large quantities of steam are produced which must be evacuated from the grinding process in such manner that the flow of the materials through the grinding apparatus remains undisturbed. As explained in U.S. patent application Ser. No. 808,713, it is known to utilize the heat content of the steam by discharging it at as high a pressure as possible without disturbing the actual process of fibre production. This is achieved by feeding the fibre pulp together with the processing steam into a pressure cyclone in which a steam-pressure considerably higher than atmospheric pressure is maintained. The steam separated from the pulp in the pressure cyclone may then be conveyed at an equivalent pressure to other production steps requiring the use of steam at superatmospheric pressures.

A pressure cyclone of this type, especially as designed for the separation of high-pressure steam from fibre pulp, is provided with an entrance duct for the fibre pulp, an escape duct for the steam separated from the pulp and a screw conveyor for transporting the fibre pulp from which the steam has been removed, to the exit duct to which is connected a device for discharging the separated pulp allowing a steam-pressure to be maintained in the cyclone substantially higher than atmospheric pressure. This discharge device may be some form of vapour-tight feeder, such as a high-density pump (gear pump), cell feeder, etc.

However, it now appears that difficulties may arise as the fibre pulp is discharged from the pressure cyclone in that blockages may occur in the exit duct of the screw conveyor just before the discharging device, causing the screw itself to be stuck. The principal objective of the present invention is to achieve a simple device for eliminating the risk of the screw being stuck.

SUMMARY OF THE INVENTION

The invention contemplates a device for relieving the blockage of the pulp discharge passage in a cyclone forming part of the pulping system comprising a throat which tapers towards the discharge valve and in which a correspondingly tapered screw conveyor normally rotates snugly to propel the steam liberated pulp stock towards the discharge valve. The shaft of the screw conveyor is mounted to reciprocate within the throat so that the flights of the screw will yield in response to a predetermined excessive thrust resulting from blockage of the throat by compacted pulp stock, to provide a by-pass between the screw flights and the throat wall to thereby relieve the blockage.

BRIEF DESCRIPTION OF THE DRAWING

In the following paragraphs the invention will be described in greater detail by reference to the embodiment illustrated in the drawing.

DESCRIPTION OF A PREFERRED EMBODIMENT

Figure 1:
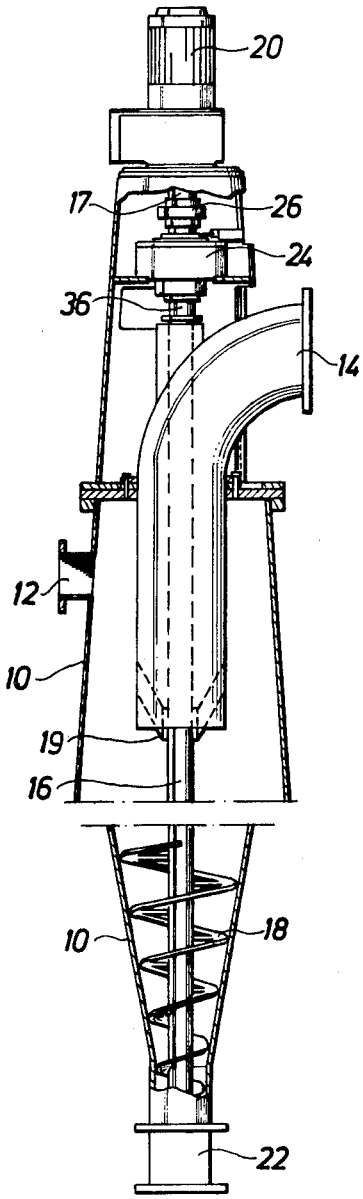
FIG. 1 shows a vertical section through a pressure cyclone in which, for the sake of simplicity, a part of the middle section of the cyclone has been omitted.

The cyclone illustrated in FIG. 1 comprises a lower housing 10 provided with an entrance duct 12 for the fibre pulp from which the pressurized steam is to be removed, and an upper housing 11 containing the bearings and driving motor for the screw conveyor, which are to be described below. A steam evacuation duct, passing centrally through the cyclone 10, 11, is designated by the number 14. The cyclone may be incorporated in a system for the production of fibre pulp by methods indicated, for instance, in co-pending U.S. application Ser. No. 808,713 filed June 21, 1977 mentioned above. A conveyor screw 18, for conveying the fibre mass after the steam has been substantially removed, is mounted on a shaft 16 running centrally through the housing 10. The screw 18 has a contour and is inserted into the downward-tapering, conical lower end of the lower cyclone housing 10. The shaft 16 on which the screw is mounted passes through the steam evacuation duct 14, in which it is supported at one point 19, and runs out through the top end of the lower cyclone housing 10 into the upper cyclone housing 11, which contains a bearing housing 24 to be described in greater detail below. Outside the housing 11 a driving motor 20, fitted with gears if necessary, is mounted on the upper wall of the cyclone to drive the screw 18. At the lower end of the cyclone 10 a discharge device 22 is fitted for vapour-tight discharge of the pulp, thus ensuring that the pressure within the cyclone is maintained at superatmospheric level. The discharge device 22 should therefore be of the valve type, such as a high-density pump, gear pump, cell feeder or the like.

Figure 2:
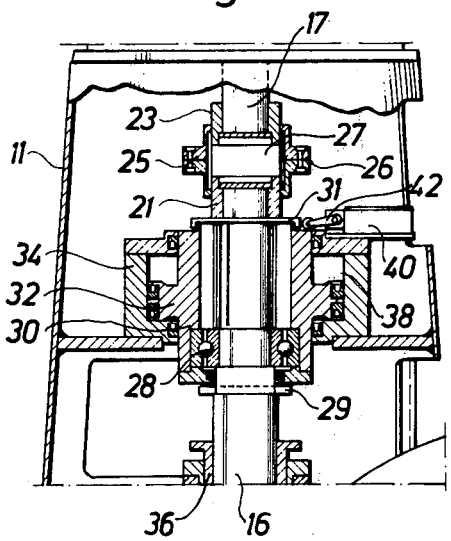
FIG. 2 shows a section through the upper bearing of the screw conveyor appearing in FIG. 1.

During operation of the cyclone, the steam separated from the pulp will pass out of the cyclone through the steam evacuation duct 14, while the pulp from which the steam has been separated will leave the cyclone via the screw 18 and pulp discharger 22. To ensure trouble-free discharge of the pulp from the cyclone, these discharging devices must therefore be capable of operating at a constant rate of discharge. However, under certain conditions the fibre pulp may be compacted by the screw 18, in the throat above the pulp discharger 22 with the result that the screw will jam and stop. According to the invention the screw shaft 16, as is particularly apparent in FIG. 2, is arranged so as to be vertically displaceable in its bearing 24. The screw shaft 16 is divided into sections 16 and 17, which are separated by a mutual spacing member 27 and firmly joined by means of a conventional coupling 26 of conventional type, which is already known per se which allows the sections 16, 17 of the screw shaft to be jointly displaced without breaking the drive connection between the two sections. To achieve this end, the coupling 26 comprises a sleeve assembly 25 in which the ends of the shaft sections 16, 17 are mounted in sleeves 21, 23 so as to be non-rotatable relative to one another yet capable of a sliding motion. The upper portion of the screw shaft section 16 is journalled in bearings 28 mounted in a housing 30, a part 32 of which is widened and designed to act as a piston. The housing is held securely in place between a thrust collar on the shaft 16 and the sleeve coupling 21 mounted at the end of the shaft by means of washers 29, 31. The bearing housing 30 and pistons 32 are designed to reciprocate snugly inside an outer housing 34 which is itself mounted in the housing 11 of the cyclone. The shaft 16, the bearing housing 30 and the piston 32 are therefore jointly moveable in a vertical direction a distance equal to the stroke of the piston 32 moving in the cylinder formed by the outer housing 34 without interrupting the driving connection with the shaft 17 and motor 20. A slide bearing 36 below the bearing 24 is provided to guide the motion of the shaft 16. Under normal operating conditions the bearing housing and the piston 32 will be in the lower position, as illustrated in FIGS. 1 and 2, and the screw will assume its normal running position while allowing the shaft 16 and screw 18 to be raised vertically in the event of clogging, as will be described in greater detail below.

The sealed chamber 38 in the housing 34 above the piston 32 is connected to a source of pressure, such as a compressed air source (not shown), and is maintained at a preset pressure which normally retains the piston 32, the shaft 16 and screw 18 in the lower position as illustrated in the drawing. If the screw is overloaded, increased of thrust pressure will be exerted on the screw in an upward direction along the screw shaft 16. If this increased pressure is great enough to cause the thrust pressure to exceed the preset pressure exerted upon the upper side of the piston 32, the piston 32, along with the screw shaft 16 and screw 18, will be forced upwards against the preset pressure prevailing in the chamber 38, thereby relieving the pressure on the screw 18. As soon as the condition causing the screw to be temporarily overloaded is relieved, the preset pressure maintained in the chamber 38 will force the piston 32 and screw shaft 16 back down to their normal operating position. The embodiment shown includes a sensor 40, an arm 42 of which bears upon the housing 30 and senses the movements of the housing 42 and piston 32. The sensor 40 may thus be used to control the rate of discharge of the discharging device 22, so that at the moment the screw is relieved of the increased thrust pressure the discharger 22 increases its r.p.m. or operating speed. An increased amount of material is thereby discharged from the cyclone and the condition causing the increased pressure is eliminated. It is also possible to modify the speed of the screw 18 in order to increase discharge rate should overloading of the type described above occur. Clearly the sensor may also be used to indicate the movements and/or position of the piston and screw.

Naturally, the embodiment illustrated here is only one example of other possible versions of the invention and other designs are conceivable. Thus, pressure-loading of the piston and screw shaft in a downward direction may also be achieved by a spring-loaded device, or the like, instead of creating pressure by the use of air, oil or other pressure medium.

I claim:

1. In a pulping system in which the pulp stock is treated in an environment of superatmospheric steam and discharged together with the steam into a cyclone separator wherein the steam is separated from the pulp stock and evacuated while the steam-liberated pulp stock is impelled through a discharge passage towards a discharge valve means which is controlled to maintain a predetermined rate of discharge and superatmospheric pressure within the cyclone, the improvement comprising:

(a) a throat member forming part of said discharge passage and tapering towards the discharge valve means;

(b) a screw conveyor having correspondingly tapered screw flights mounted to a shaft to rotate snugly in said throat to propel the pulp stock under a predetermined force towards the discharge valve means, and means for rotating said shaft;

(c) the shaft of said screw conveyor being mounted to reciprocate within said throat during the rotation thereof to allow the screw flights to yield in response to a predetermined excessive thrust resulting from compacted pulp stock blocking the throat, to provide a by-pass passage between the screw flights and the surrounding throat wall;

(d) said shaft comprising two sections, one of said sections supporting said screw flights, the terminal portions of said two opposing shaft sections being interconnected by means of a thrust collar for allowing said one of said shaft sections to reciprocate in said throat while maintaining said other shaft section non-reciprocal, said other shaft being journaled in the end wall of said cyclone opposite to said throat and having a portion projecting beyond said end wall engaging with said means for rotating said shaft, wherein said one of said shaft sections can be reciprocated in said throat without disengaging said shaft from said means for rotating said shaft.

2. Apparatus according to claim 1, in which said one of said shaft sections of the screw conveyor comprises piston means arranged to reciprocate within a cylinder fixedly mounted in the cyclone separator, said cylinder being connected to a pressure source for exerting a predetermined yieldable force on said piston to impart to the screw flights sufficient thrust to normally propel the pulp stock through said throat.

3. Apparatus according to claim 2, comprising pneumatic means for controlling the said pressure source.

4. Apparatus according to claim 2, comprising hydraulic means for controlling said pressure source.

5. Apparatus according to claim 2, comprising spring means for controlling said pressure source.

6. Apparatus according to claim 2 comprising sensor means for sensing the movement of said piston and effective to control the speed of rotation of said shaft in response to relieved blockage in the throat.

7. Apparatus according to claim 6, in which said sensor means is selectively effective to control the rate of discharge by said discharge valve.

8. Apparatus according to claim 2 wherein said one of said shaft sections projects beyond said cylinder, the distance reciprocated by said one of said shaft sections corresponding to the stroke of said piston.

* * * * *